US007138973B2

(12) United States Patent
Okafuji et al.

(10) Patent No.: US 7,138,973 B2
(45) Date of Patent: Nov. 21, 2006

(54) CHOLESTERIC LIQUID CRYSTAL DISPLAY DEVICE AND DISPLAY DRIVER

(75) Inventors: Masaharu Okafuji, Yokoham (JP); Koji Nimura, Ohtsu (JP); Manabu Takami, Fukushima (JP)

(73) Assignee: Nanox Corporation, Fukushima (JP)

( * ) Notice: Subject to any disclaimer, the term of this patent is extended or adjusted under 35 U.S.C. 154(b) by 385 days.

(21) Appl. No.: 10/284,603

(22) Filed: Oct. 31, 2002

(65) Prior Publication Data

US 2003/0085858 A1 May 8, 2003

(30) Foreign Application Priority Data

Nov. 2, 2001 (JP) ..... 2001-337438

(51) Int. Cl.
*G09G 3/36* (2006.01)

(52) U.S. Cl. ..... 345/98; 345/94; 345/95

(58) Field of Classification Search ..... 345/87–104, 345/53, 208; 349/169, 179
See application file for complete search history.

(56) References Cited

U.S. PATENT DOCUMENTS

| | | | | | |
|---|---|---|---|---|---|
| 5,013,137 | A | * | 5/1991 | Tsuboyama et al. | 349/191 |
| 5,661,632 | A | * | 8/1997 | Register | 361/683 |
| 5,748,277 | A | | 5/1998 | Huang et al. | |
| 5,949,408 | A | * | 9/1999 | Kang et al. | 345/169 |
| 6,133,895 | A | | 10/2000 | Huang | |
| 6,154,190 | A | * | 11/2000 | Yang et al. | 345/94 |
| 6,268,840 | B1 | | 7/2001 | Huang | |
| 6,278,429 | B1 | | 8/2001 | Ruth et al. | |

* cited by examiner

*Primary Examiner*—Amr A. Awad
*Assistant Examiner*—Steven Holton
(74) *Attorney, Agent, or Firm*—RatnerPrestia

(57) ABSTRACT

A display driver is provided which is suitable for driving dynamically a cholesteric liquid crystal display panel of a passive matrix drive type. The driver comprises a shift register for shifting a row data or column data inputted to the driver, a data latch circuit for latching the row data or column data from the shift register, and a drive voltage select/output circuit for selecting at least one of a plurality of voltage supplies and outputting a row drive voltage or column drive voltage to form an alternated drive voltage which activates picture elements of the liquid crystal panel.

8 Claims, 15 Drawing Sheets

CHOLESTERIC LIQUID CRYSTAL DISPLAY DEVICE AND DISPLAY DRIVER

FIELD OF THE INVENTION

The present invention relates to a display driver for driving a cholesteric liquid crystal panel, and a cholesteric liquid crystal display device (a cholesteric LCD).

BACKGROUND OF THE INVENTION

As current typical LCD, STN (super twisted nematic) LCD and TFT (thin film transistor) LCD have existed. While STNLCD has a relatively low cost, the number of drive lines thereof is at most 500. The TFTLCD is also expensive to manufacture. Therefore, a problem is caused in that a large size display device can not be fabricated with these LDCs. On the other hand, the number of drive lines of the cholesteric LCD is not limited, because rewrite and refresh are carried out only when display is to be changed, and the display is held due to the memory characteristic of the LCD once it has been written. The cholesteric LCD, however has a problem such that rewriting requires excessive time.

The current cholesteric LCD necessitates more than 10 seconds to rewrite 1000 lines in the display panel. On the other hand, a page size application such as an electronic book requires less than one second for rewriting one page so as to match the time required to turn over one page of a book manually.

To this requirement, U.S. Pat. No. 5,748,277 "Dynamic drive method and Apparatus for a bistable liquid crystal display" discloses a method for rewriting a passive matrix LCD within one second, the display using cholesteric liquid crystal. The method intends to increase the rewriting speed of the display panel by utilizing a dynamic drive method and a pipeline scheme, the dynamic drive method utilizing a series of stages to control the transition of liquid crystal textures. Such a high speed rewriting scheme allows a display panel using cholesteric liquid crystal material to be used in a passive matrix drive method (i.e. a simple matrix drive method) having an addressing speed more than 1000 lines/second.

FIG. 1 shows an electronic book 10 disclosed in the U.S. Pat. No. 5,748,277. The electronic book comprises a display screen 12, a page selection switch 14, and a memory card or floppy disk 16 which can carry the information to be viewed.

FIG. 2 shows the structure of a liquid crystal panel using a passive matrix drive method disclosed in the above-described U.S. Patent. The structure thereof comprises glass plates 20 and 22, row electrodes 24, and column electrodes 26. Cholesteric liquid crystal is sandwiched between two glass substrates 20 and 22.

Picture elements are formed between opposite row and column electrodes which selectively activate the picture elements. Such activation causes the liquid crystal to exhibit various liquid crystal textures in response to different conditions of electrical fields applied thereto. The liquid crystal assumes the homeotropic texture at a higher voltage. The twisted planar texture and focal conic texture may be stable in the absence of an electric field. The transient twisted planar texture occurs when an applied electric field holding the liquid crystal in the homeotropic texture is suddenly reduced or removed. This state is transient to either the twisted planar or focal conic texture. The liquid crystal of twisted planar state reflects light in the visible spectrum depending on the pitch length of the material to allow the display of white color. The homeotropic state and focal conic state show a weak scattering condition or a transparent condition. If the back side of a picture element is colored in black, the picture element is displayed in black for the homeotropic state and focal conic state. Also, a full-color display may be implemented by stacking display layers, each of these layers reflecting red, green, or blue light. Gradation display may be realized in a cholesteric liquid crystal display panel due to a gray scale characteristic obtained by selecting a voltage and/or time duration the voltage is applied.

In accordance with a dynamic drive method, the cholesteric liquid crystal picture elements are activated in a series of steps to control their transitions during the refresh or update of the display screen. These steps include three active stages and one non-active stage, three active stages consisting of a preparation stage, selection stage, and evolution stage. The non-active stage exists before the preparation stage and behind the evolution stage, respectively. The non-active stage before the preparation stage does not transform the liquid crystal texture. The dynamic drive method using three active stages is referred to as a three-stage scheme.

The preparation stage transforms the liquid crystal to a homeotropic state. The selection stage selects either the maintaining of a homeotropic state or the transformation to a transient twisted planar state. The evolution stage evolves the liquid crystal selected so as to be transformed to the transient twisted planar state during the selection step to a focal conic state, and holds the homeotropic state of the liquid crystal selected to remain in the homeotropic state during selection stage. The final non-active stage maintains the focal conic state as it is, and transforms the homeotropic state to a stable twisted planar state.

A four-stage scheme may be implemented by adding a pre-selection stage behind the preparation stage, the pre-selection stage allowing the liquid crystal to relax to a transient twisted planar state. Adding the pre-selection stage may increase the speed for activating the picture elements.

In the drive method using a series of stages, the determination of a final liquid crystal texture of a picture element depends upon the voltage applied to the electrodes during the selection stage, with the applied voltages during other stages being the same. All of the picture elements, therefore, require the same non-active voltage, the same preparation voltage, and the same evolution voltage, so that the time may be shared during the non-active stage, preparation stage, and evolution stage by employing a pipeline argorithm. Accordingly, a plurality of electrodes may be addressed at the same time by a non-active voltage, preparation voltage, and evolution voltage.

In the above-described U.S. Patent, while applied voltages to the row electrodes and column electrodes have a vibrating bipolar square waveform, respectively, it is known that a vibrating unipolar square waveform may be used by selecting the magnitude of applied voltage and the time duration of applied voltage. Using a unipolar square waveform results in the decrease of a swing width of voltage applied to a display driver and the cost reduction of the driver. Whether the applied voltage is bipolar voltage or unipolar voltage, the voltage applied to a picture element, i.e. the voltage difference between the voltages applied to a row electrode and column electrode is a bipolar voltage. Such bipolar voltage applied to a picture element is referred to as an alternating voltage hereinafter. The reason why an alternating voltage is used is to decrease the effect of impurities dissolved in liquid crystal material and expand the life time of the liquid crystal material.

SUMMARY OF THE INVENTION

An object of the present invention is to provide a display driver for dynamically driving a cholesteric liquid crystal display device of a passive matrix drive type.

Another object of the present invention is to provide a display driver which may be shared in both of a row driver and column driver.

A further object of the present invention is to provide a display driver in which a conventional drive method and a dynamic drive method may be switched, the state of a liquid crystal texture in the conventional drive method being transformed by one stage.

A further object of the present invention is to provide a display driver having a partial rewriting function.

A further object of the present invention is to provide a cholesteric liquid crystal display device having a function to carry out a high-speed rewriting in an interlaced scanning.

A further object of the present invention is to provide a cholesteric liquid crystal display device having a dual drive function.

A further object of the present invention is to provide a cholesteric liquid crystal rectangular display device in which a skew is decreased.

A first aspect of the present invention is a display driver for driving a passive matrix liquid crystal display panel using cholesteric liquid crystal material. The driver comprises a shift register for shifting a row data or column data inputted to the driver, a data latch circuit for latching the row data or column data from the shift register, and a driver voltage select/output circuit for selecting at least one of a plurality of voltage supplies and outputting a row drive voltage or column drive voltage to form an alternated drive voltage which activates picture elements of the liquid crystal panel.

The drive voltage select/output circuit comprises, a select circuit for generating a select signal to select at least one of the plurality of voltage supplies by the row data or column data latched by the data latch circuit, and a voltage output circuit for outputting the row drive voltage or column drive voltage by the voltage supplies selected by the select signal.

A second aspect of the present invention is a cholesteric liquid crystal display device. The display device comprises a passive matrix liquid crystal display panel using cholesteric liquid crystal material, a first driver set in a row mode for supplying row drive voltages to row electrodes of the panel, a second driver set in a column mode for supplying column drive voltages to column electrodes of the panel, and a controller for controlling the first and second drivers.

DETAILED DESCRIPTION OF THE PREFERRED EMBODIMENT

Determination of a final liquid crystal texture of a picture element depends on a voltage applied to the picture element, the voltage being created by a difference between drive voltages to a row electrode and column electrode. Both a row driver for driving row electrodes and a column driver for driving column electrodes have the same function in supplying a drive voltage, so that a display driver according to the present invention has a structure which may be shared in both a row driver and column driver.

Figure 3:
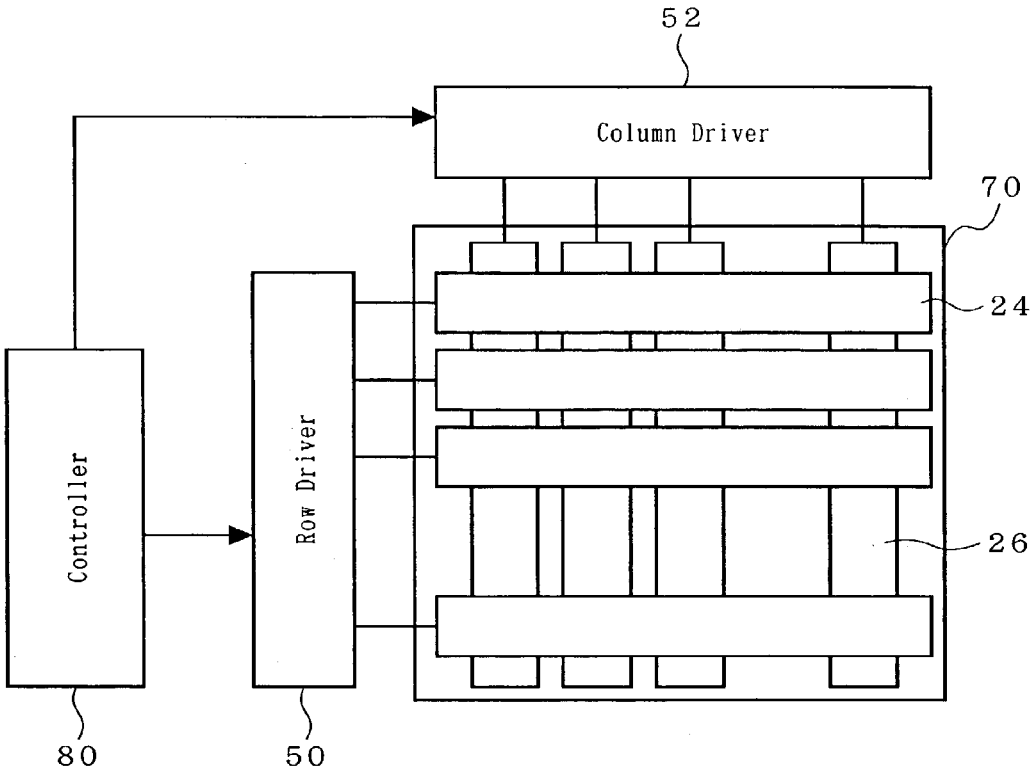
FIG. 3 shows a cholesteric liquid crystal display device.

FIG. 3 shows a cholesteric liquid crystal display device using a row driver and column driver which have the same structure. Row electrodes 24 of a liquid crystal panel 70 are connected to output terminals of a row driver 50, and column electrodes 26 are connected to output terminals of a column driver 52. Depending upon control signals and data supplied from a controller 80, drive voltages are supplied from the row driver 50 to the row electrodes 24, and drive voltages are supplied from the column driver 52 to the column electrodes 26. The differential voltages between the voltages from the row drive and column driver are supplied to picture elements of the liquid crystal panel 70. The differential voltages are alternating square voltages which are varied to positive and negative levels.

Figure 4:
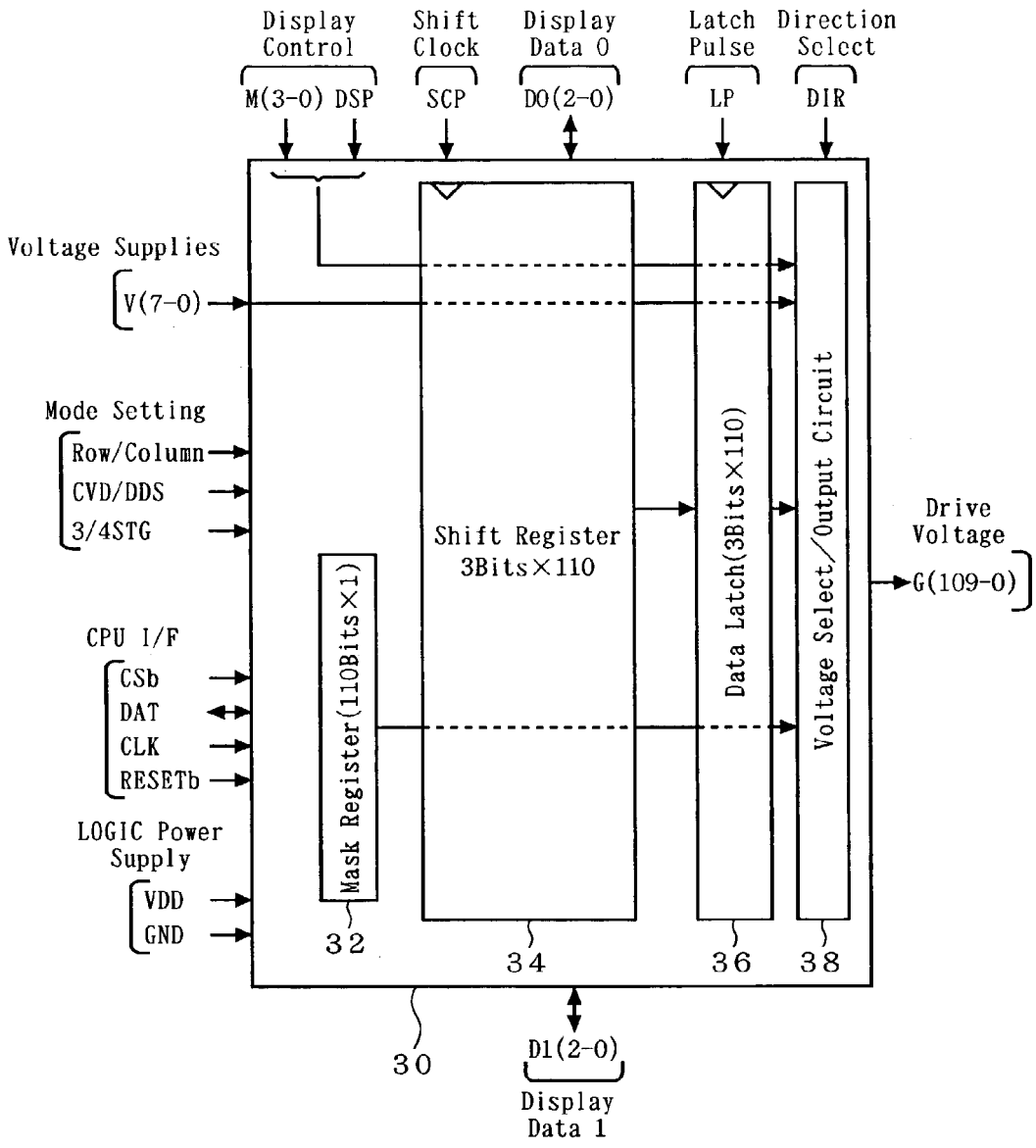
FIG. 4 shows a block diagram of a display driver according to the present invention.

FIG. 4 shows a block diagram of a display driver 30 according to the present invention which can be shared in both of the row driver 50 and column driver 52. The driver in FIG. 4 may be operated as a row driver or column driver by a row/column mode signal.

Figure 5:
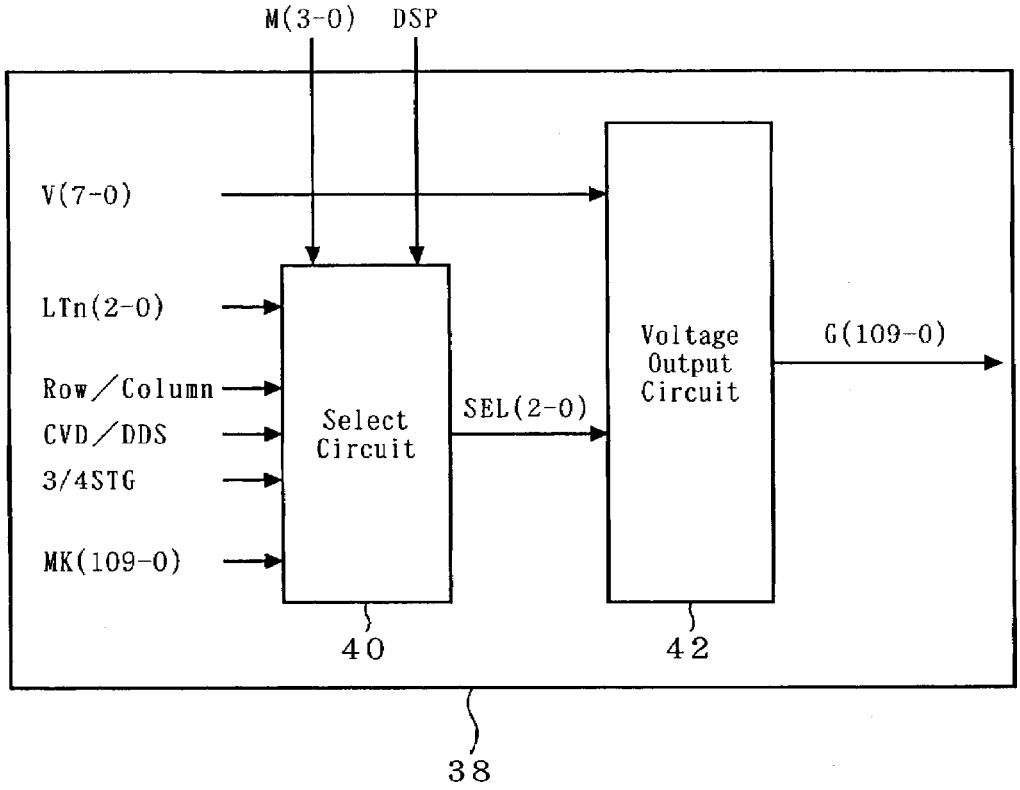
FIG. 5 shows the structure of a voltage select/output circuit.

The driver 30 comprises a mask register 32, a shift register 34 (3 bits×110), a data latch circuit (3 bits×110), and a circuit 38 for selecting and outputting voltages to the liquid crystal panel 70. The driver is controlled by a controller such as a central processing unit (CPU). The structure of the voltage select/output circuit 38 is shown in FIG. 5. The circuit 38 comprises a select circuit 40 and a voltage output circuit 42. Respective signals supplied to the driver 30 will now be described.

Chip Select Signal (CSb):

This signal is supplied from a CPU to select a chip as a row or column driver. "0" is for selection, and "1" is for non-selection. Using this signal, a data clock (CLK), and a data bus signal (DAT), the register 34 in the driver 30 may be accessed.

Data Bus Signal (DAT):

This signal is for reading and writing the register 34 in the driver 30, and operates in synchronized with the rise timing of the CLK.

Data Clock (CLK):

Using the CLK, the chip select signal CSb, and the data bus signal DAT, the register 34 in the driver 30 may be read and written.

Reset Signal (RESETb):

This signal is for initializing the driver 30. The driver is initialized by "0".

Voltage Supplies for Driving a Liquid Crystal Panel (V7–V0):

These voltage supplies are for driving the liquid crystal panel and are connected to the voltage output circuit 42 in the voltage select/output circuit 38 as shown in FIG. 5.

In the case of the row driver 50, respective output voltages from the voltage supplies V7, V6, V5, V4, V3, V2, V1 and V0 are 40.0V, 36.0V, 32.0V, 25.5V, 14.5V, 8.0V, 4.0V and 0V, for example.

In the case of the column driver 52, respective output voltages from the voltage supplies V5, V4, V3, V2, V1 and V0 are 40.0V, 36.0V, 32.0V, 28.0V, 8.0V, and 0V, for example.

Which voltage supply is selected depends on select signals SEL (2-0) generated in the select circuit 40 shown in FIG. 5.

Signals for Alternation (M3–M0):

These signals are for controlling the alternation of the voltages which activate the picture elements of the liquid crystal panel 70, and are supplied to the select circuit 40 in the voltage select/output circuit 38.

Display Enable Signal for the Liquid Crystal Panel (DSP):

The signal decides normal display or display inhibition. "0" designates display inhibition (the voltage supply V0 is selected), and "1" normal display. The signal is supplied to the select circuit 40 in the voltage select/output circuit 38.

Direction Select Signal (DIR):

The signal switches the input/output of display data and the transfer direction thereof.

Row/Column Mode Signal (Row/Column):

When the signal is "1", the driver 30 operates as a row driver, and when the signal is "0", the driver 30 operates as a column driver. The signal is supplied to the select circuit 40 in the voltage select/output circuit 38.

Conventional/Dynamic Signal (CVD/DDS):

When the signal is "1", the driver conventionally operates, and when the signal is "0", the driver dynamically operates. The signal is supplied to the select circuit 40 in the voltage select/output circuit 38.

3-stage/4-stage Signal (3/4 STG):

When the signal is "1", the driver carries out a 3-stage operation, and when the signal is "0", the driver carries out a 4-stage operation. The signal is supplied to the select circuit 40 in the voltage select/output circuit 38.

Display Data 0 (D0 (2-0)) and Display Data 1 (D1 (2-0)):

These Data are input/output data for the shift register 34. In the case that the driver operates as a row driver, these data are used as input data for gray scale display. The input/output direction of the input/output data is switched by the direction select signal DIR.

Table 1 shows the switching of input/output direction of the data by the direction select signal.

TABLE 1

| DIR | D0 (2-0) | D1 (2-0) |
|---|---|---|
| 1 | Input | Output |
| 0 | Output | Input |

A display data (Di) which are set as an input data is acquired into the shift register 34 at the rise timing of the shift clock SCP. A display data (Do) which are set as an output data is outputted from the final stage of the shift register 34.

Shift Clock (SCP):

The rise of the shift clock causes the display data Di to acquire into the shift register 34.

Ratch Pulse (LP):

The rise of the latch pulse causes the display data Di acquired into the shift register 34 to latch into the data latch circuit 36.

Drive Voltage Outputs (G(109-0)):

The drive voltage outputs are determined by the display data Di latched by the latch pulse LP in the circuit 36, and are supplied to the electrodes of the liquid crystal panel 70.

Next, the components of the display driver 30 will now be described.

Mask Register 32:

The mask register 32 controls corresponding drive output voltages of the voltage select/output circuit 38, which has a capacity of 110 bits. The mask register 32 is written only when the driver operates in a row mode.

Table 2 shows the correspondence between the mask data Mk (109-0) and the drive voltage outputs (119-0).

TABLE 2

| Mask Data | Bit | Output | Value in Reset |
|---|---|---|---|
| MK0 | 0 | G0 | 1 |
| \| | \| | \| | \| |
| MK109 | 109 | G109 | 1 |

When a bit is set to "0", all of the latch data LTn (2-0) are masked to select the output drive voltages. When the bit is set to "1", the latch data are not affected.

Shift Register 34:

The shift register shifts the input display data at the rise timing of the shift clock SCP, which has a capacity of 3 bits×110. The shift direction of the data is determined by the direction select signal DIR.

Tables 3 and 4 show the input/output of the display data D1 and D0, and the transfer direction of the shift register 34.

TABLE 3

| DIR | D0 (2-0) | D1 (2-0) |
|---|---|---|
| 1 | Input | Output |
| 0 | output | Input |

TABLE 4

| DIR | Transfer Direction |
|---|---|
| 1 | (D0 → G0) → (G109 → D1) |
| 0 | (D1 → G109) → (G0 → D0) |

Data Latch Circuit 36:

The data latch circuit 36 has a capacity of 3 bits×110, and latches the output data from the shift register 34 at the rise timing of the latch pulse LP.

Voltage Select/Output Circuit 38:

The circuit comprises the select circuit 40 and the voltage output circuit 42, the select circuit 40 generating the select signal SEL (2-0) by the mode setting (Row/Column, CVD/DDS, 3/4 STG), the latched data LTn (2-0), the signals for alternation M (3-0), the display enable signal DSP and the mask data MK (109-0), and the voltage output circuit 40 outputting the drive voltages based on the select signal from the circuit 40. The voltage output circuit 42 comprises 110 voltages output terminals G(109-0).

The select signal SEL (2-0) transferred from the select circuit 40 to the voltage output circuit 42 is 3 bits of SEL0, SEL1, and SEL2. Table 5 shows the relation of the three bits and the output voltages.

TABLE 5

| SEL | | | OUTPUT |
|---|---|---|---|
| SEL2 | SEL1 | SEL0 | Output Voltage |
| 0 | 0 | 0 | V0 |
| 0 | 0 | 1 | V1 |
| 0 | 1 | 0 | V2 |
| 0 | 1 | 1 | V3 |
| 1 | 0 | 0 | V4 |
| 1 | 0 | 1 | V5 |
| 1 | 1 | 0 | V6 |
| 1 | 1 | 1 | V7 |

When the driver 30 constructed as described above is used as a row driver, the select signal SEL (2-0) inputted from the circuit 40 to the circuit 42 are recognized as a stage, thereby selecting one voltage from the eight voltage supplies V(7-0) to output it from the output terminal.

When the driver is used as a column driver, the select signal SEL (2-0) inputted from the circuit 40 to the circuit 42 are recognized as a data for gray scale, thereby selecting one voltages from the eight voltage supplies V(7-0) to output it from the output terminal.

Figure 6:
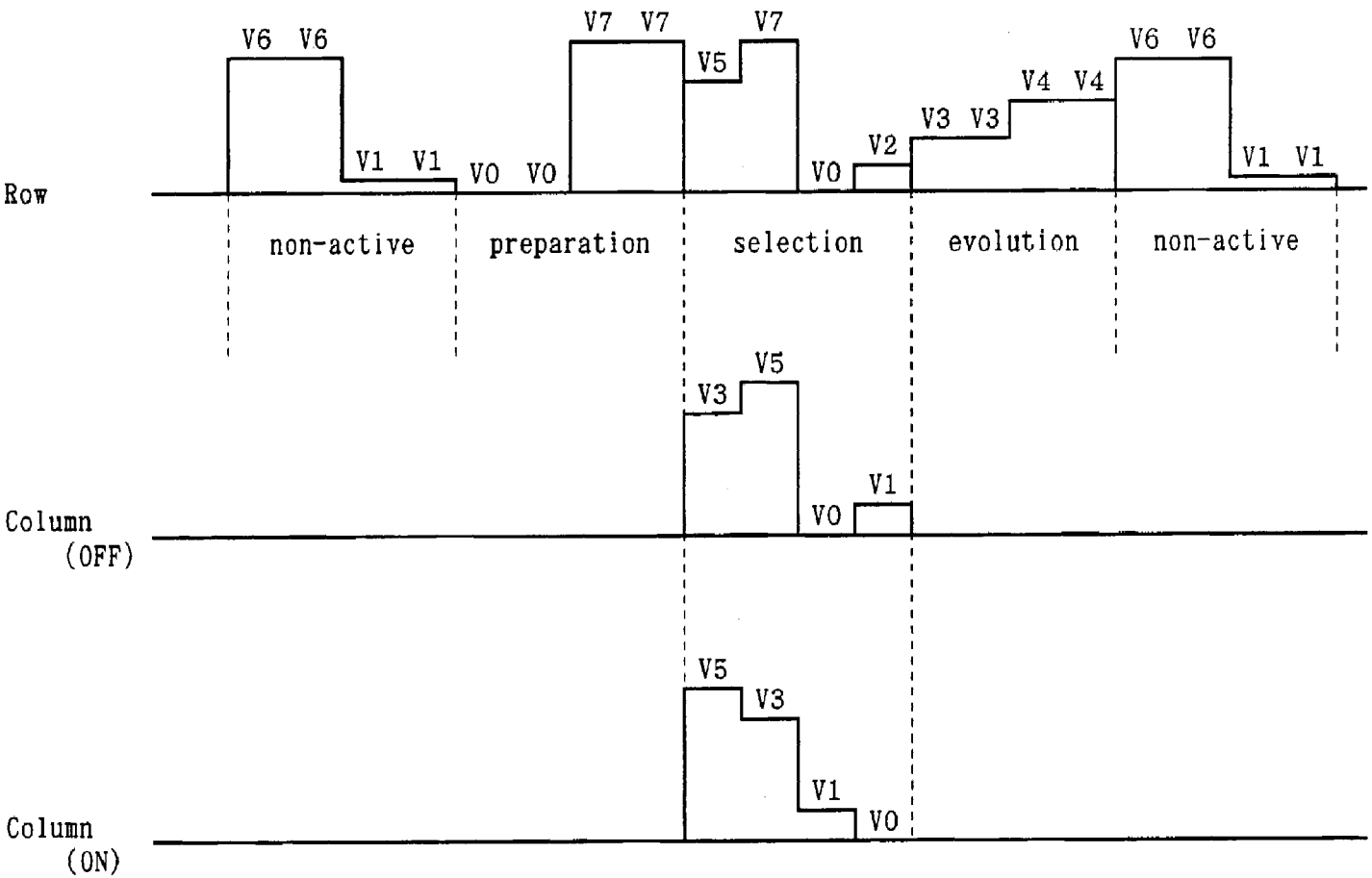
FIG. 6 shows an example of waveforms of row drive voltages and column drive voltages in three-stage dynamic drive for two-gray scale display.

FIG. 6 shows an example of waveforms of row drive voltages and column drive voltages in three-stage dynamic drive for the two-gray scale display (ON, OFF). The row drive unipolar voltages shown in FIG. 6 are supplied to the row electrodes 24 of the panel 70 to dynamically drive the row electrodes in the order of the non-active stage, the preparation stage, the selection stage, the evolution stage, and the non-active stage. When the row electrode 24 is in the selection stage, the column drive voltage is supplied to the column electrode 26 from the column driver 52. Depending on the waveform of the column drive voltage, the final liquid crystal texture (focal conic state or planar state) of a picture element is determined.

Figure 7:
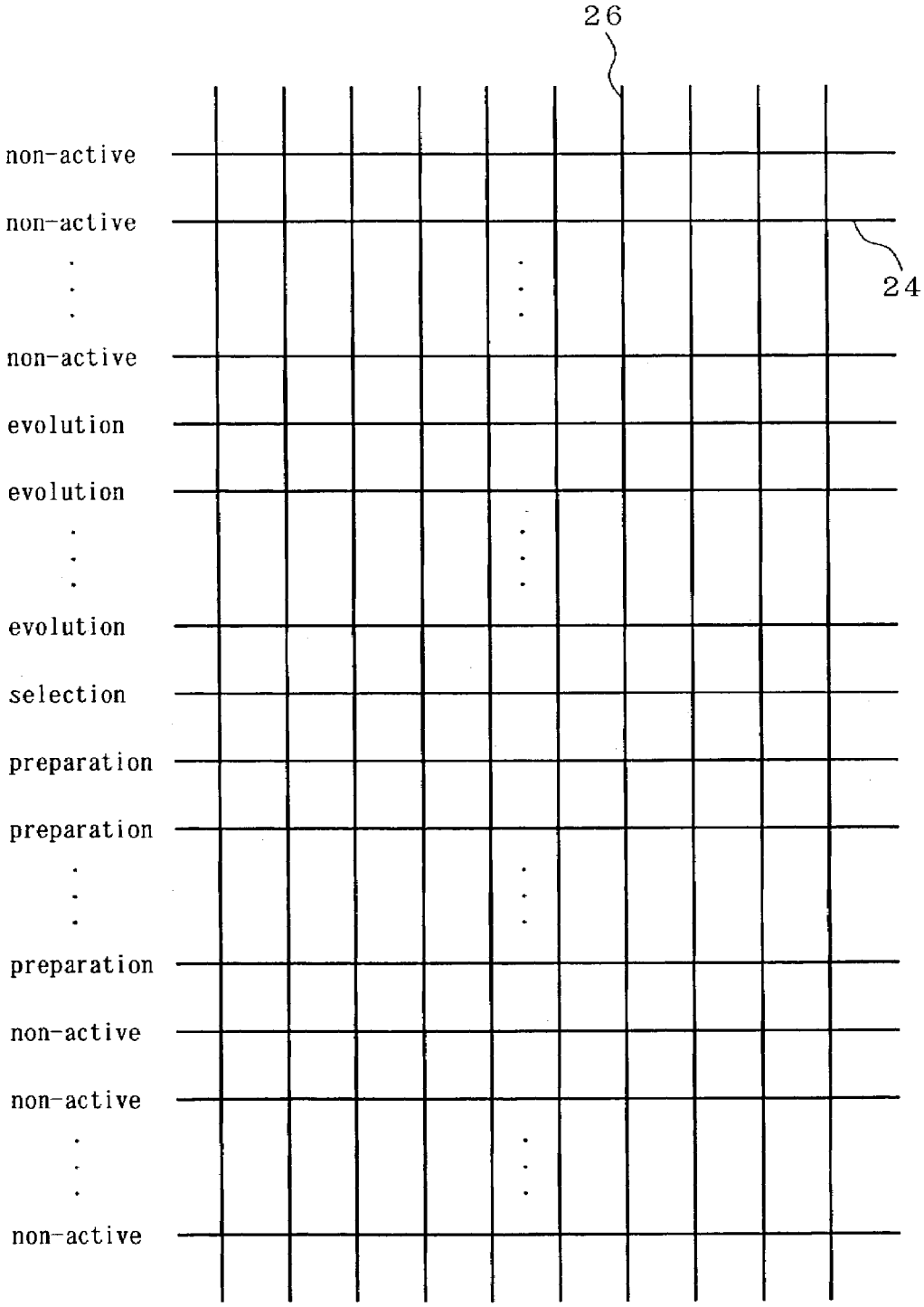
FIG. 7 shows the state of stages developed on the row electrodes of a liquid crystal panel at a given time.

FIG. 7 shows the state of the stages developed on the row electrodes 24 of the liquid crystal panel 70 at a given time. In the figure, the reference numeral 24 designates a row electrode, and 26 a column electrode. As stated before, the dynamic drive method may employ a pipeline drive scheme, so that a non-active stage, a preparation stage, and an evolution stage may drive a plurality of row electrodes 24 at the same time. On the contrary, only one row electrode is driven in a selection stage. While the three-stage dynamic drive method has been explained in the foregoing, the four-stage dynamic drive method may be utilized if more faster drive speed is required.

Figure 8:
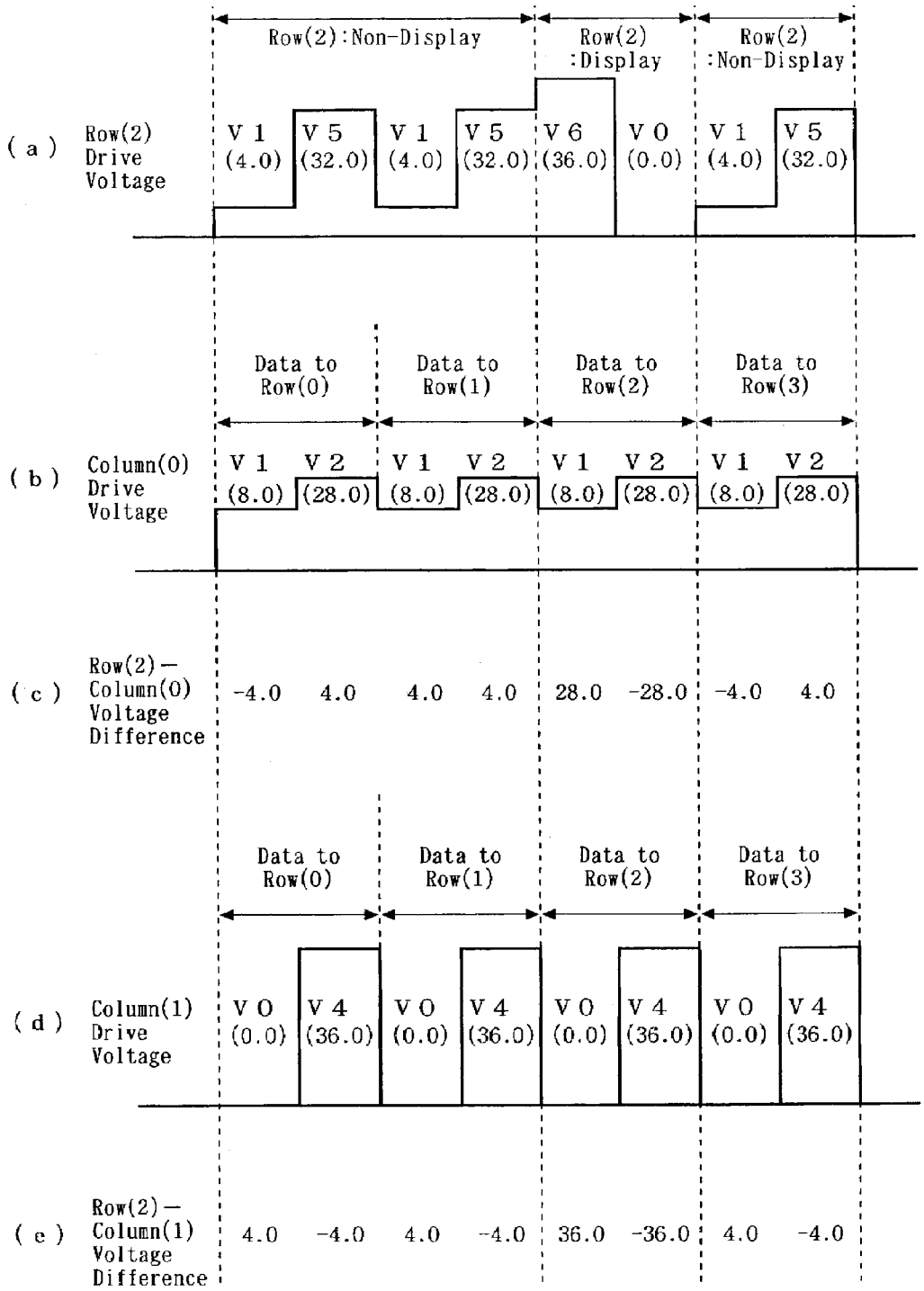
FIG. 8 shows an example of waveforms of row drive voltages and column drive voltages in a conventional drive for two-gray scale display.

FIG. 8 shows an example of waveforms of row drive voltages and column drive voltages in a conventional drive for the two-gray scale display. The waveform (a) is of the drive voltage to the row electrode (2), the waveform (b) is of the drive voltage to the column electrode (0), (c) is the voltage difference between the drive voltage to the row electrode (2) and the drive voltage to the column electrode (0), the waveform (d) is of the drive voltage to the column electrode (1), and (e) is the voltage difference between the drive voltage to the row electrode (2) and the drive voltage to the column electrode (1). As apparent from (c) and (e), the difference between the row drive voltage and the column drive voltage is an alternated voltage.

As stated above, the conventional drive method is a method for transforming the state of a liquid crystal texture in one stage, and has the lower drive speed compared with the dynamic drive method.

As apparent from FIG. 8, the liquid crystal texture is transformed to a focal conic state when the drive voltage (V1, V2) is applied to the column electrode during the row electrode is in a display stage, and the liquid crystal texture is transformed to a planar state when the drive voltage (V0, V4) is applied to the column electrode. In FIG. 8, the non-display stage is a stage for maintaining the display stage.

According to the present invention, while any one of the four-stage dynamic drive method, the three-stage dynamic drive method, and the conventional drive method may be selected based on a circumferential temperature. While the two-gray scale display has been explained hereinbefore, the four-gray scale display also may be implemented by selecting a liquid crystal texture of an intermediate state between a transparent state and a reflection state based on the value and time duration of applied drive voltage.

Next, a partial rewrite method for a display device using a 110-bit mask register 32 will now be described. As a cholesteric liquid crystal material has a memory characteristic, "a partial rewrite" method may be utilized in updating the display screen to allow a fast speed rewrite, in which a partial area required to be updated in the display screen may be selectively rewritten.

Figure 1:
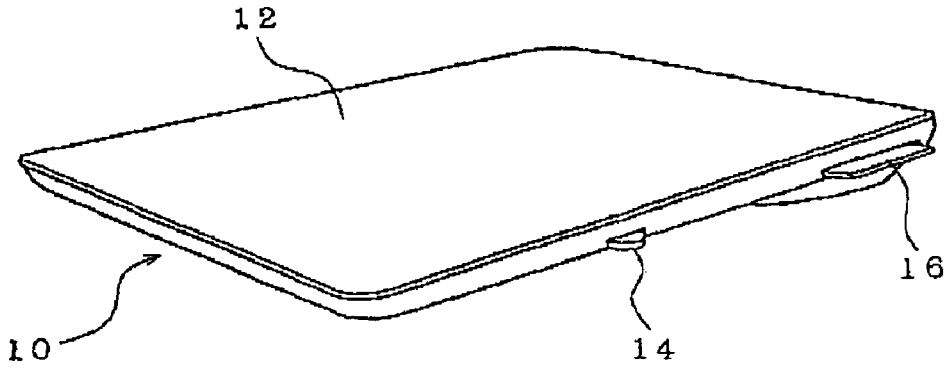
F I G. 1 PRIOR ART
FIG. 1 shows a perspective view of an electronic book.
Figure 2:
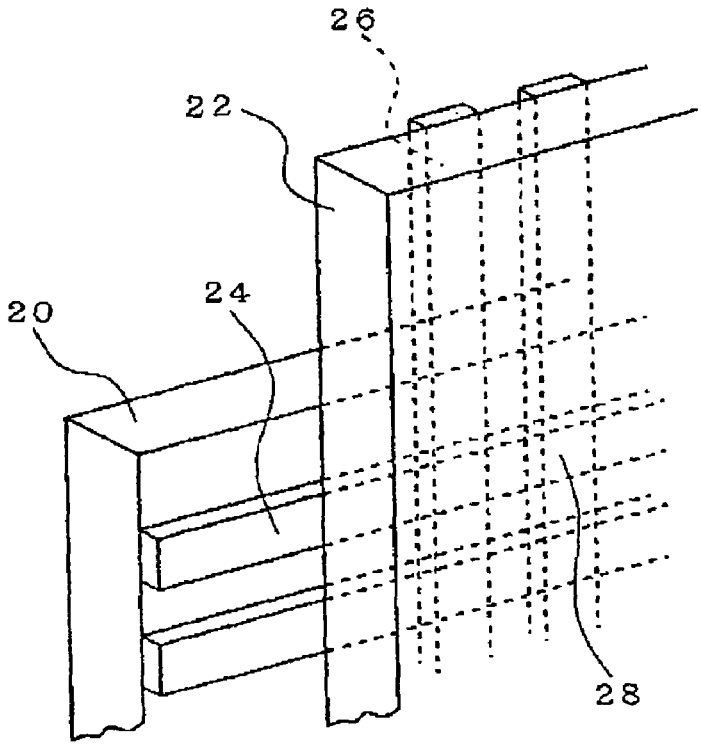
F I G. 2 PRIOR ART
FIG. 2 shows the structure of a liquid crystal panel using a passive matrix drive method.
Figure 9:
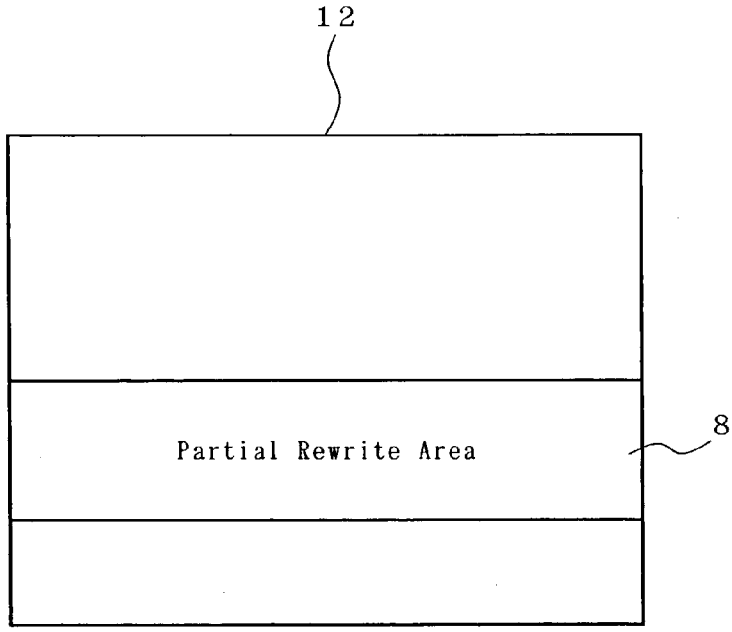
FIG. 9 shows a partial rewrite area in the display screen of an electronic book.

FIG. 9 shows a partial rewrite area 8 in the display screen 12 of the electronic book 10 shown in FIG. 1 during the update of the display screen. In order to rewrite the partial area 8, the corresponding bits of the 110-bit mask register 32 are set to "0" to mask the latch data LTn(2-0) corresponding to the area where the rewrite is not required, and the corresponding bits of the mask register 32 are set to "1" not to affect the latch data corresponding to the partial area where the rewrite is required. As a result, only the partial area 8 may be rewritten.

Next, a method of high speed rewrite using an interlaced scanning will now be described. In the three-stage and four-stage dynamic drive methods, the time durations of respective stages are shown in Table 6.

TABLE 6

| Stage | 3-stage Dynamic Drive (ms) | 4-stage Dynamic Drive (ms) |
|---|---|---|
| Preparation | 20 | 2.0 |
| Pre-Selection | — | 0.2 |
| Selection | 1 | 0.4 |
| Evolution | 20 | 20 |

The time durations of the non-active stages are not shown in Table 6, because they are different with reference to respective row electrodes.

Figure 10:
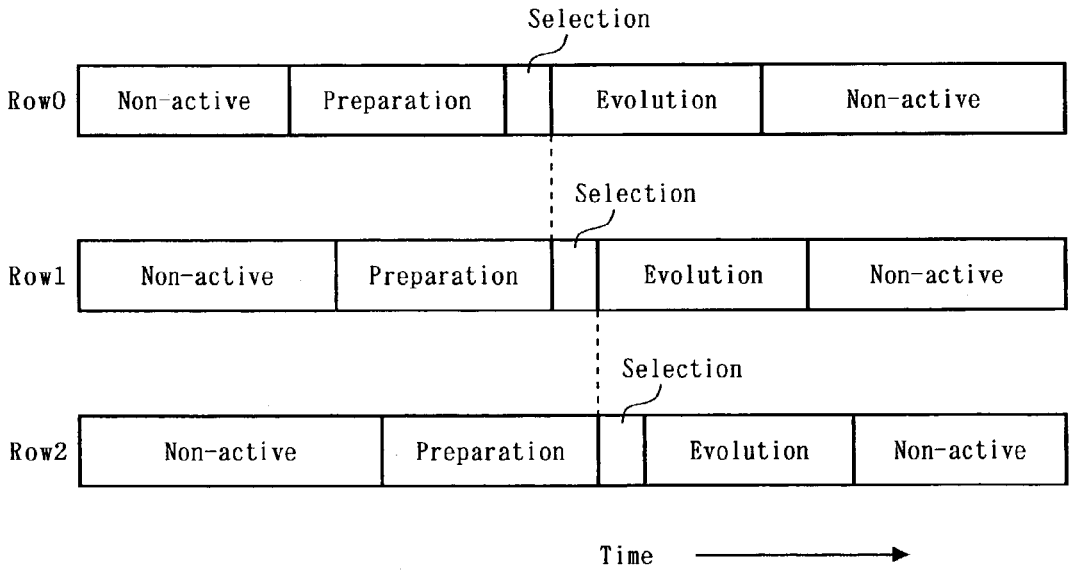
FIG. 10 shows the stages in a three-state dynamic drive.
Figure 11:
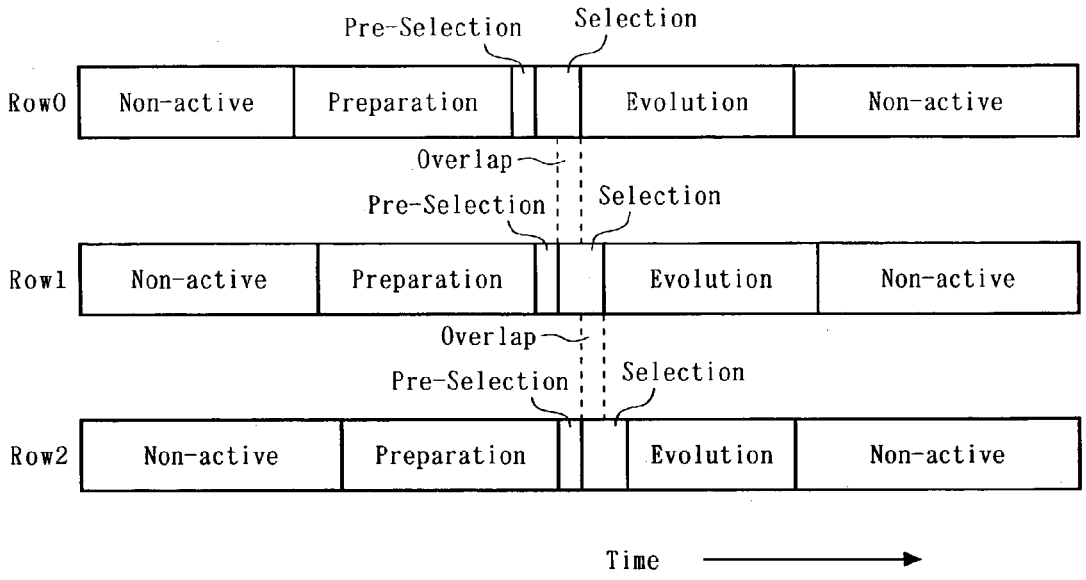
FIG. 11 shows the stages in a four-stage dynamic drive.

When the driver is operated by a pipeline drive scheme, a pipeline processing must be carried out with the smallest time duration being as a unit time. Therefore, the unit time of pipeline processing is 1 ms (the selection stage) in the three-stage dynamic drive method, and the unit time of pipeline processing is 0.2 ms (the pre-selection stage) in the four-stage dynamic drive method. FIGS. 10 and 11 show the stages in the three-stage and four-stage dynamic drive, respectively.

In the three-stage dynamic drive shown in FIG. 10, the selection stages of respective row electrodes are not overlapped in time. Therefore, the data (drive voltage) for the column electrodes to be outputted during the selection stage may be determined.

However, in the stage of the four-stage dynamic drive shown in FIG. 11, the selection stages of the row electrodes (0) and (1) are partially overlapped in time, and the selection stages of the row electrodes (1) and (2) are also partially overlapped in time. This means that the data for the column electrodes can not be determined during the overlapped time.

This problem may be resolved by scanning the row electrodes such that even-numbered row electrodes and odd-numbered row electrodes are separately scanned as in an interlaced scanning scheme of a television system. That is, when the even-numbered row electrodes are scanned, the odd-numbered row electrodes are set to non-active states, and when the odd-numbered row electrodes are scanned, the even-numbered row electrodes are set to non-active states. As a result, the selection stages in different electrodes are not caused at the same time when the even-numbered or odd-numbered electrodes are scanned.

The interlaced scanning scheme is carried out by controlling the row driver 50 in FIG. 3. Using this interlaced scanning scheme, the time required to rewrite one display screen in the four-stage dynamic drive method is as follows; [(time duration of preparation stage)+(time duration of pre-selection stage)+(selection stage)×(number of rows)÷2+(time duration of evolution stage)]×2=[20 ms+0.2 ms+0.4 ms×(number of rows)÷2+20 ms]×2. In this case, the time duration of the first and final non-active stages are calculated as 0 ms for simplicity.

For comparison, the time required to rewrite one display screen in the three-stage dynamic drive method in which the interlaced scanning is not required is calculated, the result thereof is as follows; (time duration of preparation stage)+(time duration of selection stage)×(number of rows)+(time duration of evolution stage)=20 ms+1 ms×(number of rows)+20 ns.

Therefore, if the-number of the row electrodes is larger than 67, the time required to rewrite one display screen in the four-stage dynamic drive method is shorter than in the three-stage dynamic drive method.

Next, a dual drive method will now be described. In the case that eight-gray scale method is carried out using the driver for four-gray scale method, for example, the size of a display screen may be limited. When the time interval between latch pulses LP is 20 μs and the time required to transfer a data for one picture element is 25 ns (the frequency of shift clock SCP is 40 MHz), a data for only 800 picture elements may be transferred.

Figure 12:
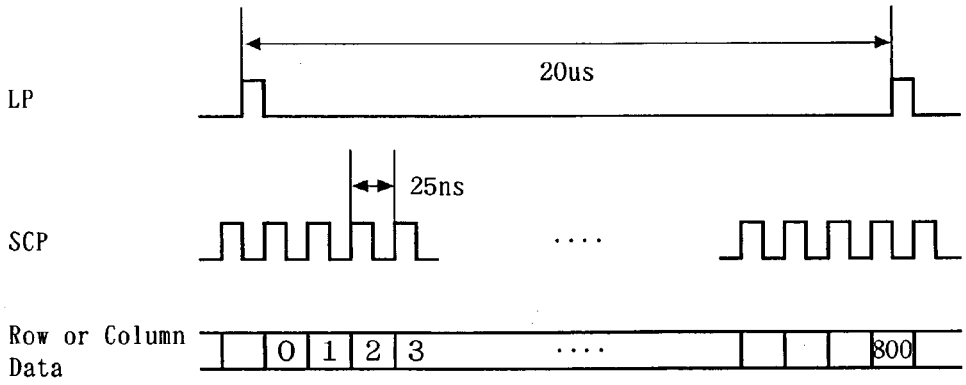
FIG. 12 shows a timing diagram of waveforms for explaining the display of 800 rows×800 columns.
Figure 13:
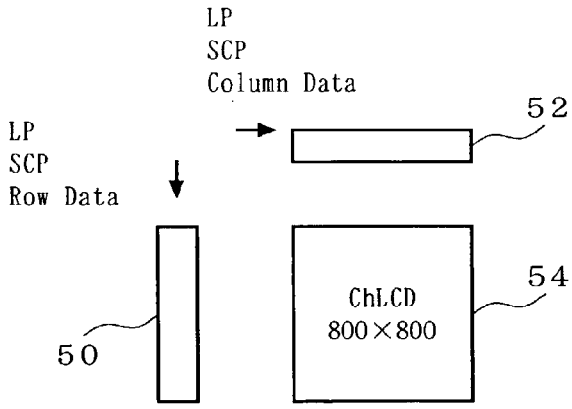
FIG. 13 shows a display screen of 800 rows×800 columns.

This situation may be illustrated in a timing diagram of waveforms shown in FIG. 12. FIG. 13 also shows that only a display screen of 800 rows×800 columns may be implemented by the above-described drive method. In FIG. 13, the reference numerals 50 and 52 designate a row driver and column driver, respectively, and 50 designates a display screen of 800 rows×800 columns.

In order to make the size of a display screen large, it is conceivable to increase a data transfer speed. However, a data for only 1600 picture elements may be transferred even if the data transfer speed is doubled, so that the size of a display screen is still limited.

In order to dissolve this problem, the inventors of this application have conceived a dual drive method in which a data is injected to the intermediate portions of rows and columns. Using this dual drive method, the limitation for the number of picture elements is eliminated, and the size of a display screen may be large.

Figure 14:
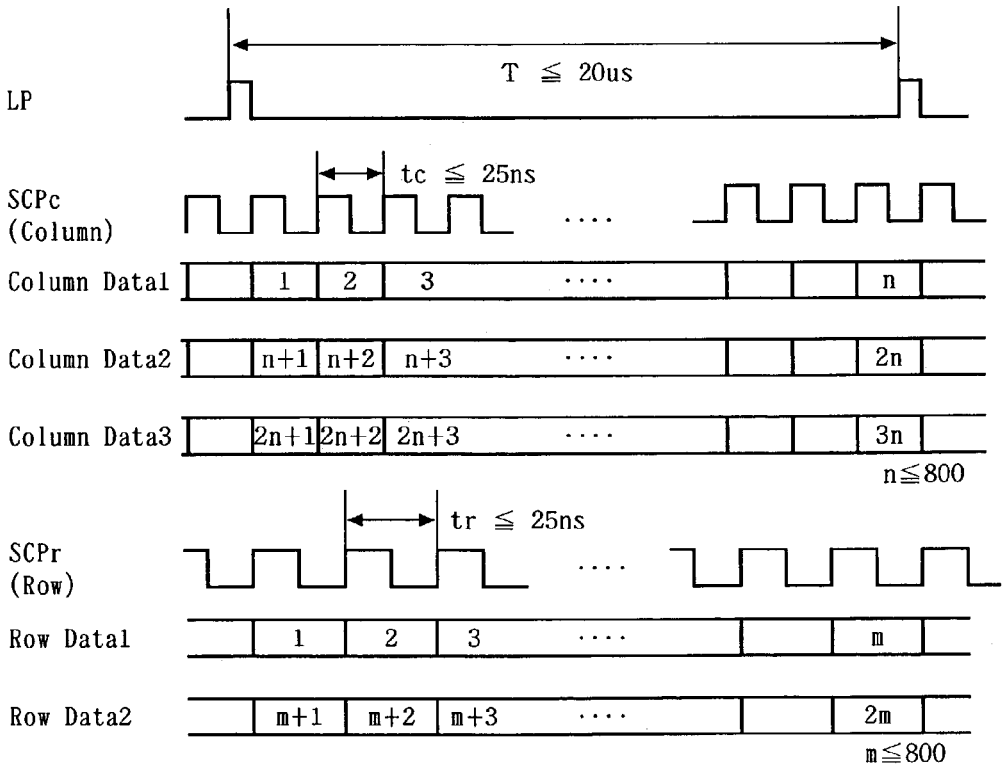
FIG. 14 shows a timing diagram of waveforms for illustrating a dual drive method.
Figure 15:
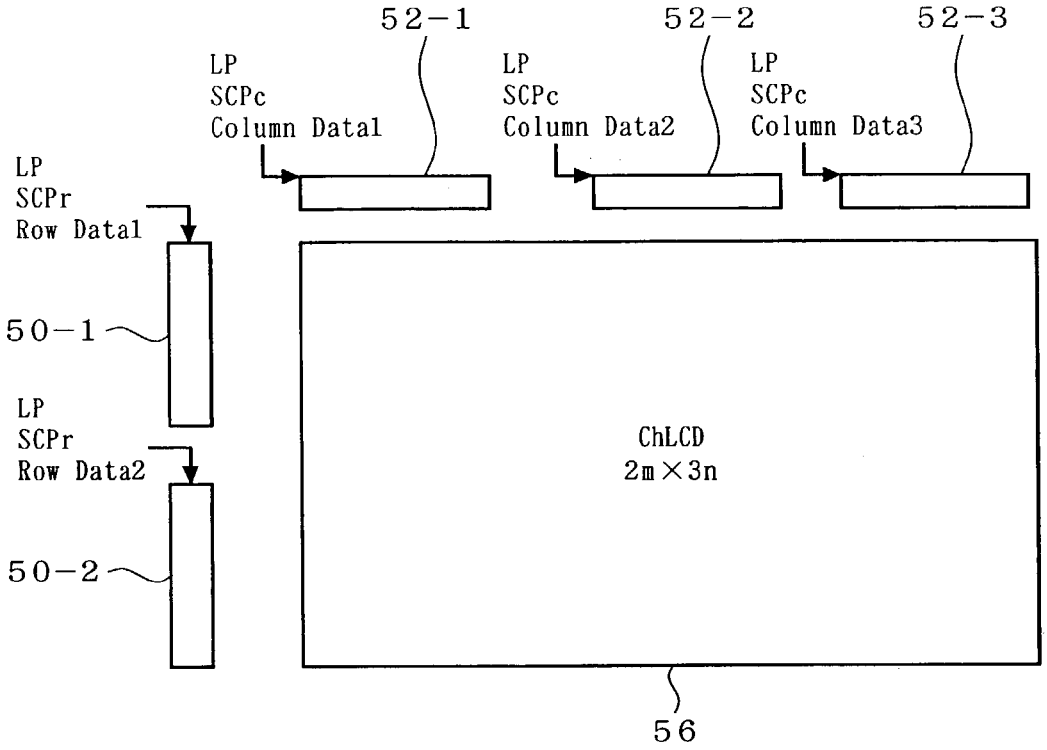
FIG. 15 shows an arrangement of row drivers and column drivers for implementing a dual drive method.

FIG. 14 is a timing diagram of waveforms for illustrating the dual drive method. The arrangement of row drivers and column drivers to implement the dual drive method is shown in FIG. 15. As is shown in FIG. 14, the time interval T between the latch pulses LP is 20 μs or less, the time period $t_c$ between the shift clocks SCPc for column display is 25 ns or less, and the number n of picture elements which may be transferred by one column driver is 800 or less. On the other hand, the time period $t_r$ between the shift clocks SCPc for row display is 25 ns or less, and the number n of picture elements which may be transferred by one row driver is 800 or less.

FIG. 15 shows an embodiment in which above described two row drivers 50-1 and 50-2 and three column drivers 52-1, 52-2 and 52-3 are arranged to form a display screen 56 of 2 m×3 n picture elements.

The dual drive method may be carried out by injecting each data simultaneously to the two row drivers and three column drivers. Now assuming that n=500 and m=600 as an example. The column data for the column electrodes 1, 2, 3, . . . , 500 are injected in turn into the first column driver 52-1. The column data for the column electrodes 501, 502, 503, . . . , 1000 are injected in turn into the second column driver 52-2. The column data for the column electrodes 1001, 1002, 1003, . . . , 1500 is injected in turn into the third column driver 52-3. In this manner, 500 column data are injected into the three column drivers, respectively, thereby 1500 column data may be transferred during the time period T of latch pulse (≦20 μs).

In the two row drivers, the row data for the row electrodes 1, 2, 3, . . . , 600 are injected in turn into the first row driver 50-1, and the row data for the row electrodes 601, 602, 603, . . . , 1200 are injected in turn into the second row driver 50-2. In this manner, 600 row data are injected into the two row drivers, respectively, thereby 1200 row data may be transferred during the time period T of latch pulse (≦20 μs).

Therefore, the size of a display screen may become large independently of the limitation for the time period T of latch pulses. It is noted that the three column drivers and two row drivers are controlled by the controller 80 in FIG. 3 to transfer the column data and row data.

Next, the treatment for skew will now be described. In the liquid crystal panel of 600 rows×800 columns (the size of one picture element is 0.11 mm×0.11 mm) used in the electronic book shown in FIG. 1, the capacitance ($C_{row}$) of a row electrode is 400 pF, and the capacitance ($C_{col}$) of a column electrode is 300 pF.

On the other hand, in a rectangular liquid crystal panel (for example, 68 rows×516 columns, and the size of one picture element is 0.54 mm×0.54 mm) used for an advertisement or the like, the capacitance of a row electrode is 6000 pF, and the capacitance of a column electrode is 800 pF.

Figure 16:
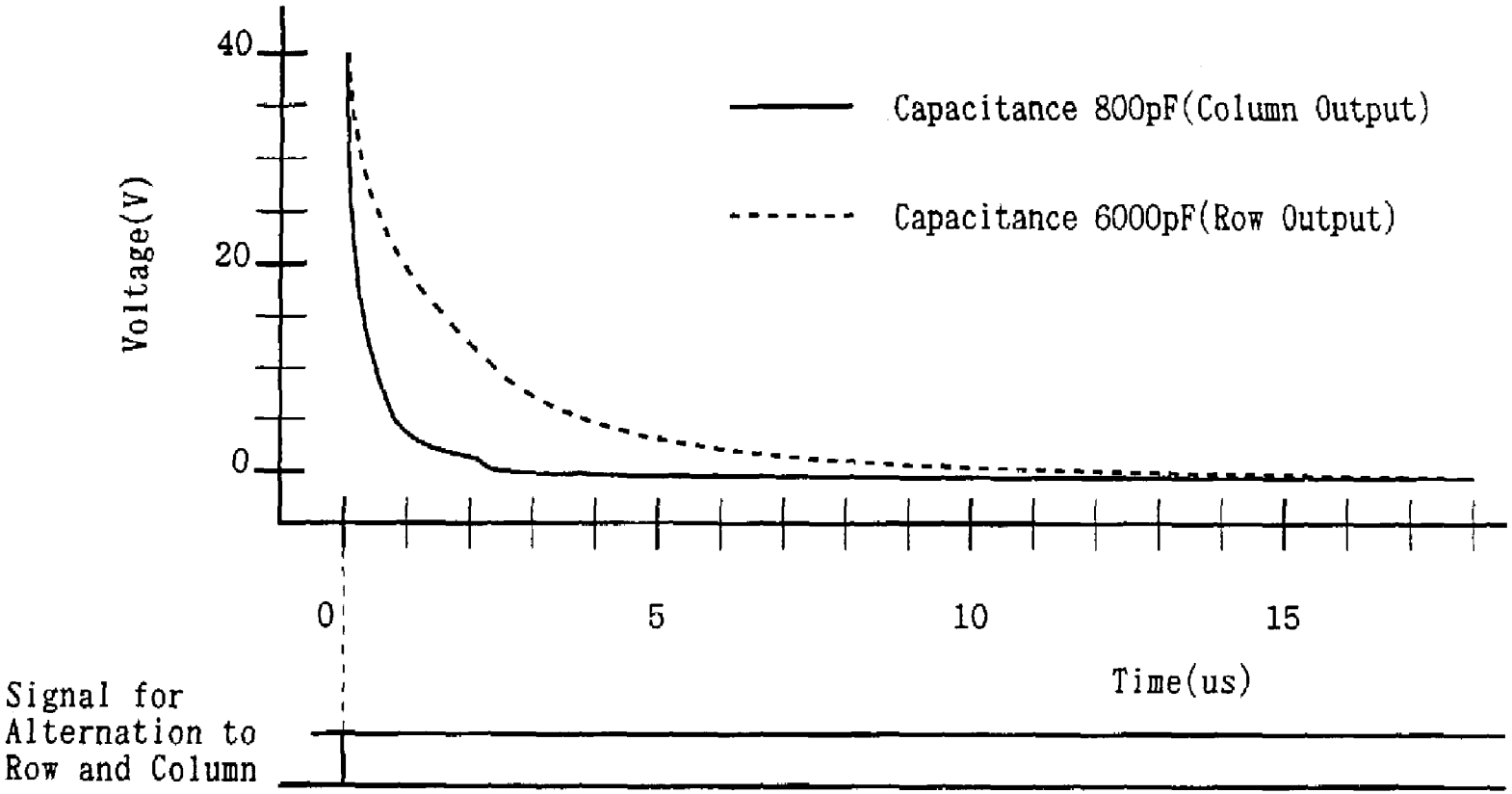
FIG. 16 shows a voltage waveform falling from 40V to 0V.
Figure 17:
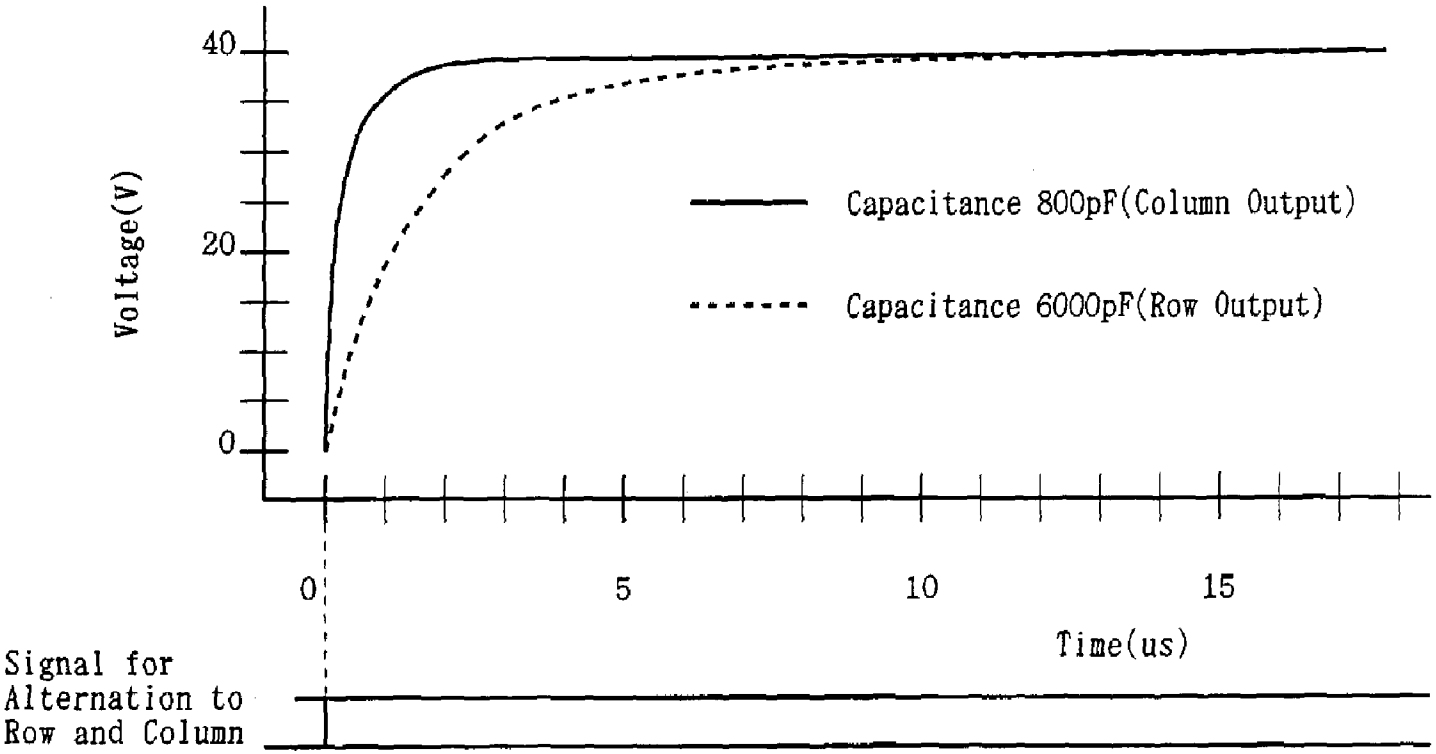
FIG. 17 shows a voltage waveform rising from 0V to 40V.

If the rectangular liquid crystal panel described above is driven by a driver which is used for driving the liquid crystal panel of the electronic book as described hereinbefore, the rise and fall of the voltage on a row electrode is delayed with respect to that of the voltage on a column voltage due to the presence of capacitance. The delay is referred to as a skew herewith. As an example, a voltage waveform falling from 40V to 0V is shown in FIG. 16. It is appreciated in the figure that the fall of a row electrode voltage shown in a dotted line is delayed with respect to that of a column electrode voltage shown in a solid line. FIG. 17 shows a voltage waveform rising from 0V to 40V. It is appreciated in the figure that the rise of a row electrode voltage shown in a dotted line is delayed with respect to that of a column electrode voltage shown in a solid line.

In the case of a dynamic drive method, a display quality may be deteriorated if a skew is present for the fall or rise of the row or column voltage. In order to avoid the deterioration, the size of an output transistor in the voltage output circuit 42 of the voltage select/output circuit 38 shown in FIG. 5 is made small such that a row electrode voltage rises or falls not so late with respect to a column electrode voltage even if the capacitance of the row electrode is large. However, this method results in a large driver.

The inventors of the present application have resolved this problem in a following manner. That is, the signal for alternation M in the column driver is delayed with respect to the signal for alternation M in the row driver, thereby improving the display quality. If the signal for alternation in the column driver is delayed with respect to the signal for alternation in the row driver, the rising waveform on the column electrode having a capacitance of 800 pF (the waveform is shown in a solid line) will be moved in parallel rightward in the figure.

Figure 18:
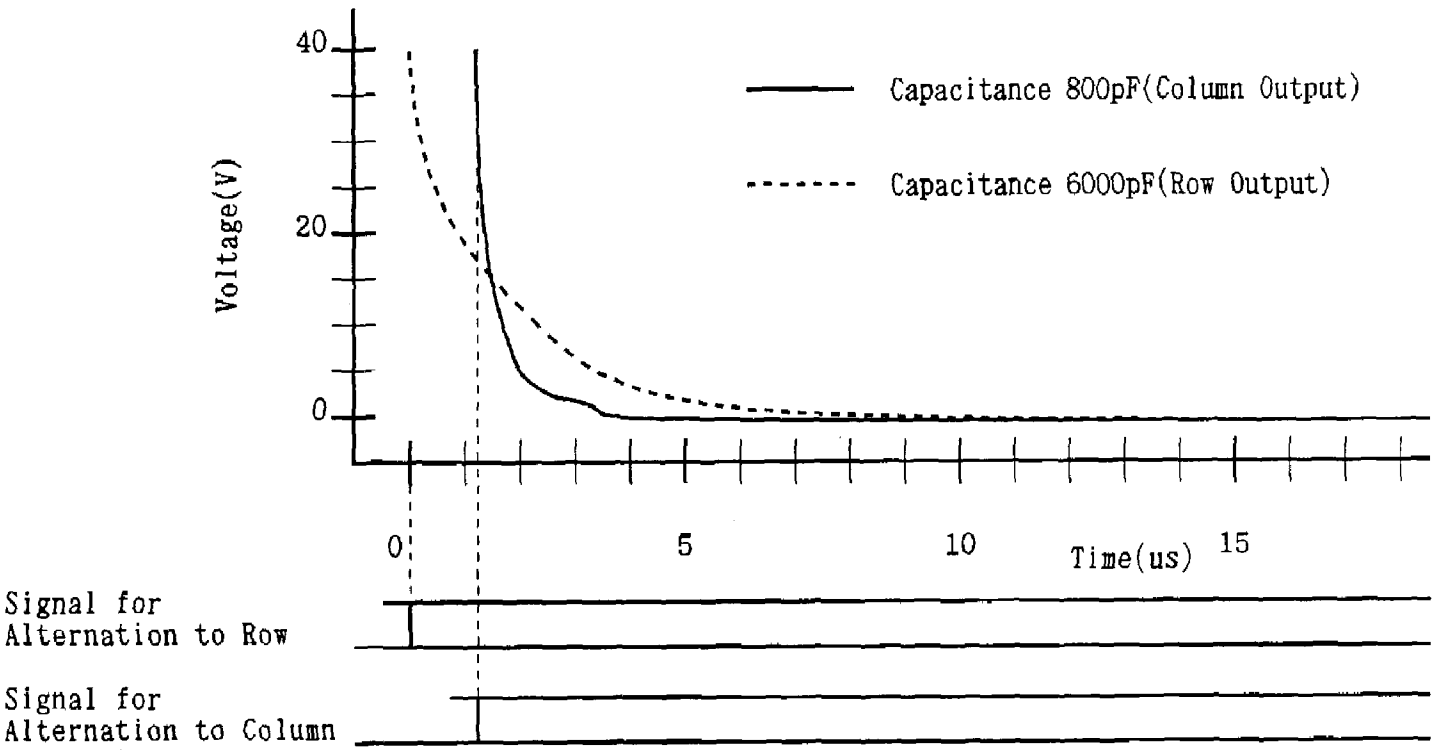
FIG. 18 shows a voltage waveform falling from 40V to 0V.
Figure 19:
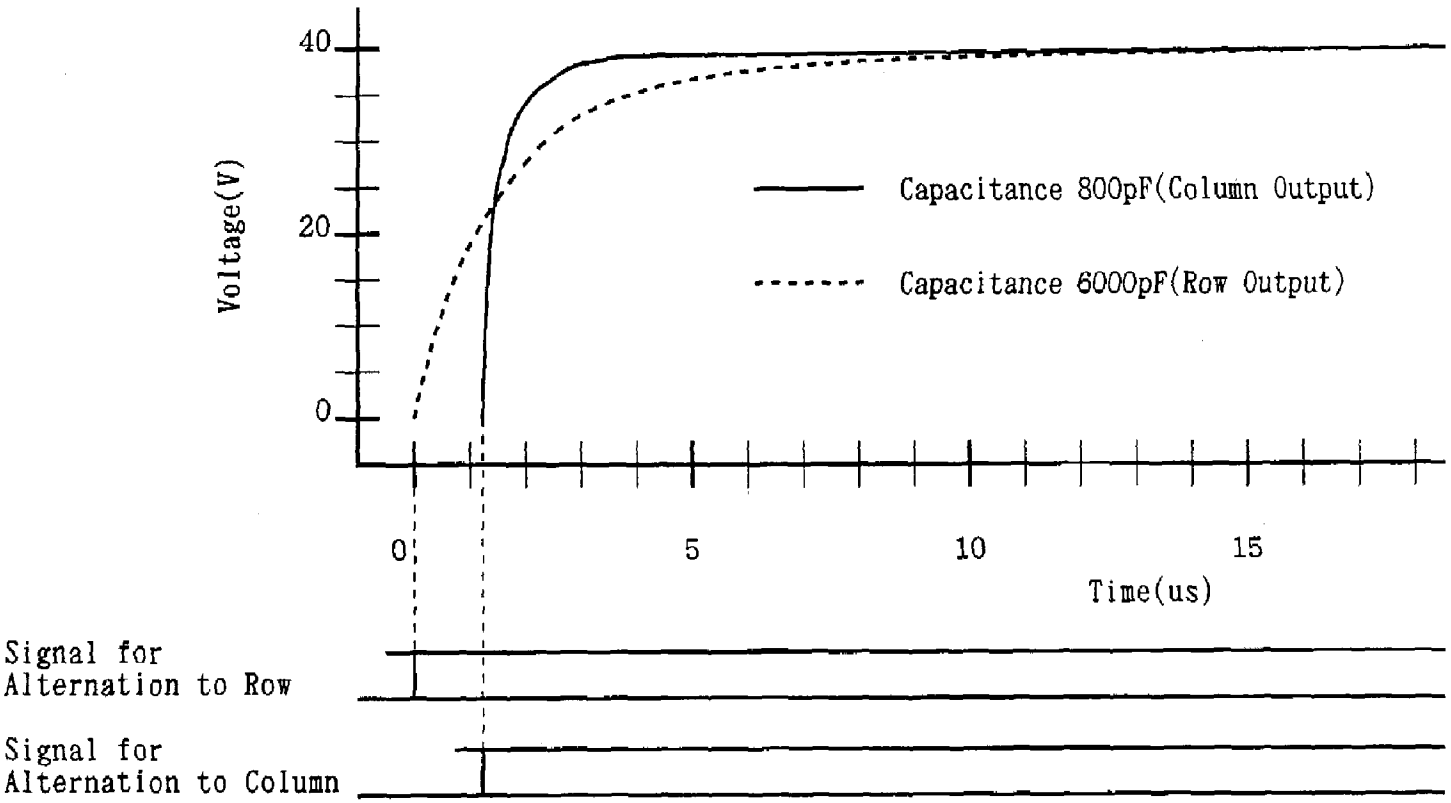
FIG. 19 shows a voltage waveform rising from 0V to 40V.

FIGS. 18 and 19 correspond to FIGS. 16 and 17, and shows that the rising waveform on the column electrode having a capacitance of 800 pF (the waveform is shown in a solid line) is moved in parallel rightward in the figures. In this manner, the degradation of a display quality may be prevented by decreasing the skew of rise or fall of the row or column electrode voltage.

The column driver 52 and row driver 50 in FIG. 3 are controlled by the controller 80 to delay the signal for alternation in the column driver with respect to the signal for alternation in the row driver. Also, a suitable display in the device may be obtained in any liquid crystal panel (if the capacitance of row electrode≧the capacitance of column electrode, the value of capacitance is arbitrary) by selecting a delay time of the signal for alternation in a unit of reference clock.

The invention claimed is:

1. A display driver for driving a passive matrix liquid crystal display panel using cholesteric liquid crystal material comprising a shift register for shifting a row data or column data inputted to the driver;

a data latch circuit for latching the row data or column data from the shift register; and a drive voltage select/output circuit for selecting at least one of a plurality of unipolar voltage supplies and outputting a row drive voltage or column drive voltage to form an alternated drive voltage which activates picture elements of the liquid crystal panel the drive voltage select/output circuit including:

a select circuit for generating the select signal to select at least one of the plurality of voltage supplies by the row data or column data latched by the data latch circuit, and a voltage output circuit for outputting the row drive voltage or column drive voltage by the voltage supplies selected by the select signal;

wherein the display driver is operated in a row mode or column mode which is set by inputting a row/column mode signal to the select circuit, and wherein the select circuit selects by a conventional/dynamic mode signal inputted thereto either of a dynamic drive in which the transition of cholesteric liquid crystal texture is controlled by a series of stages or a conventional drive in which the transition of cholesteric liquid crystal texture is controlled by one stage.

2. The display driver of claim 1, wherein the series of stages include;

a preparation stage for transforming the liquid crystal material to a homeotropic state, a selection stage for selecting either the maintaining of a homeotropic state or the transformation to a transient twisted planar state, and an evolution stage for evolving the liquid crystal material selected so as to be transformed to the transient twisted planar state during the selection step to a focal conic state, and holds the homeotropic state of the liquid crystal selected to remain in the homeotropic state during selection stage.

3. The display driver of claim 2, wherein the series of stages include;

a preparation stage for transforming the liquid crystal material to a homeotropic state, a pre-selection stage for allowing the liquid crystal material to relax to a transient twisted planar state, a selection stage for selecting either the maintaining of a homeotropic state or the transformation to a transient twisted planar state, and an evolution stage for evolving the liquid crystal material selected so as to be transformed to the transient twisted planar state during the selection step to a focal conic state, and holds the homeotropic state of the liquid crystal selected to remain in the homeotropic state during selection stage.

4. The display driver of claim 2 or 3, further comprising a mask register for masking the row data latched in the data latch circuit corresponding to the region on the panel where a rewrite is not required, when the driver is used in a row mode.

5. A cholesteric liquid crystal display device, comprising a passive matrix liquid crystal display panel using cholesteric liquid crystal material;

a first driver set in a row mode of claim 2 or 3 for supplying row drive voltages to row electrodes of the panel; a second driver set in a column mode of claim 2 or 3 for supplying column drive voltages to column electrodes of the panel; and a controller for controlling the first and second drivers.

6. The cholesteric liquid crystal display device of claim 5, wherein the controller controls the first driver such that a high speed rewrite is carried out by an interlaced scanning with the row drive voltage being supplied to separated even-numbered row electrodes and odd-numbered row electrodes.

7. The cholesteric liquid crystal display device of claim 5, wherein when difference in time is caused between the rise or fall of the row drive voltage and that of the column drive voltage, the controller controls the first and second drivers such that the difference is caused to be small by delaying the signal for alternation in one of the first and second drivers with respect to that in the other of the first and second drivers.

8. A cholesteric liquid crystal display device, comprising a passive matrix liquid crystal display panel using cholesteric liquid crystal material;

a plurality of first drivers each set in a row mode of claim 2 or 3 for supplying row drive voltages to row electrodes of the panel;

a plurality of second drivers each set in a column mode of claim 2 or 3 for supplying column drive voltages to column electrodes of the panel; and a controller for controlling the plurality of first and second drivers, wherein the controller supplies row data simultaneously to the plurality of first drivers, and supplies column data simultaneously to the plurality of second drivers.

* * * * *